US010738485B2

(12) United States Patent
Cole

(10) Patent No.: US 10,738,485 B2
(45) Date of Patent: Aug. 11, 2020

(54) TEMPORARY CORNER GUARD

(71) Applicant: Jamaal R Cole, Renton, WA (US)

(72) Inventor: Jamaal R Cole, Renton, WA (US)

( * ) Notice: Subject to any disclaimer, the term of this patent is extended or adjusted under 35 U.S.C. 154(b) by 0 days.

(21) Appl. No.: 16/019,249

(22) Filed: Jun. 26, 2018

(65) Prior Publication Data

US 2019/0078338 A1 Mar. 14, 2019

Related U.S. Application Data

(60) Provisional application No. 62/526,989, filed on Jun. 29, 2017.

(51) Int. Cl.
*E04F 13/06* (2006.01)
*E04F 19/02* (2006.01)

(52) U.S. Cl.
CPC ..... *E04F 19/028* (2013.01)

(58) Field of Classification Search
CPC ..... E04F 19/02; E04F 19/022; E04F 19/024; E04F 19/026; E04F 19/028; E04F 13/06; E04F 13/028; E06B 3/88
USPC ..... 52/211, 287.1, 288.1, 751.3; 49/57, 462; 248/345.1
See application file for complete search history.

(56) References Cited

U.S. PATENT DOCUMENTS 4,768,320 A * 9/1988 Weller ..... E04G 21/30 52/211
5,369,925 A * 12/1994 Vargo ..... B65G 1/02 211/183
6,526,708 B1 * 3/2003 Hartley ..... E06B 1/34 248/345.1
8,267,262 B2 * 9/2012 Thelwell ..... B65G 1/02 211/183
2013/0312344 A1 * 11/2013 Alonso ..... E04F 19/022 52/287.1
2014/0318052 A1 * 10/2014 McCue ..... E06B 1/52 52/211
2018/0016808 A1 * 1/2018 Hilliard ..... E04H 12/2238

* cited by examiner

*Primary Examiner* — William V Gilbert

(57) ABSTRACT

It is the object of the present invention to improve the stability of temporary corner guards. The Improved Temporary Corner Guard achieves enhanced stability through strategic selection of total device mass, mass distribution, and frictional properties of the selected materials. The Improved Temporary Corner Guard has a total device mass that is higher than commercially available corner guards. The device mass is strategically distributed, with the bulk of the weight residing in the base portion of the device. The device may also employ materials or coatings that have a higher coefficient of friction when placed against the outside corners, which would further enhance the ability to resist being upset if a lateral force is applied during use.

2 Claims, 6 Drawing Sheets

TEMPORARY CORNER GUARD

FIELD OF THE DISCLOSURE

The overall field of invention is devices and methods for protecting interior walls from damage.

BACKGROUND

Carpet is extremely prevalent as a floor covering in commercial and residential buildings. Carpet owners often choose to have their carpet professionally cleaned for a variety of reasons, including difficulty of the cleaning task, superior professional quality cleaning, and lack of access to cleaning equipment, among others. Many professional carpet cleaning services employ truck-mounted carpet cleaning equipment Truck-mounted carpet cleaning equipment incorporates the major mechanical components of the carpet cleaning equipment within a truck or van, and only hoses and hose attachments need to be brought into the building.

The hoses required for carpet cleaning equipment are generally of two types: hoses for sup plying positive pressure fluid for applying cleaning solution to the carpet, and hoses for supplying negative pressure for removing cleaning solution and contaminants. The hoses are heavy-duty to withstand repeated use and must be long enough to extend from the truck to the interior of the buildings, and consequently, the hoses may be fairly heavy. The negative pressure hoses are often corrugated or reinforced, and a ridged outer surface is common.

As the working-end of the hose is dragged into the building, the workers must maneuver it around interior walls. The hoses will tend to contact any outside corner (i.e. convex corner) around which it is dragged. Often, the wall is constructed of a material that is easily marked or marred, such as painted drywall or wood. Due to the weight and construction of the hoses, marking, marring, or otherwise damaging outside corners is a significant concern.

Carpet cleaning professionals mitigate the probability that hoses will damage outside corners within the building by placing temporary corner guards in areas that are likely to sustain damage. Temporary corner guards are typically made from durable materials, such as metal or plastic, and take the form of a pair of angled protective surfaces joined at 90 degrees that will cover and protect the area of the wall's outside corner near the ground that extend up to two feet above the floor surface and incorporate a base component that allows the corner guard to be freestanding without need to attach it to the outside corner that is being protected.

Current commercially available embodiments of temporary corner guards are not designed to be particularly stable. Carpet cleaning professionals will place the temporary corner guards to prevent damage as hoses are dragged around them, but because the temporary corner guards are not particularly stable, they are often easily upset from their original placement, which exposes the outside corner to potential damage. Some commercially available embodiments of corner guards incorporate adjustable bases that can accommodate uneven floor surfaces to enhance stability in areas where floor-height varies at the corner, such as in a stairwell. While this type of corner guard enhances stability in a specific and limited situation, it is still quite susceptible to being upset from its placement by a hose being dragged across it during the cleaning process.

Particularly, existing temporary corner guards are unstable due to a high aspect ratio, in which the center of mass of the device is easily moved outside of the bounds of the device base. The center of mass is too high, the base is too narrow, and/or the total device mass is too low to resist tipping or upsetting.

Therefore, a need exists for a temporary corner guard that resists being upset during the carpet cleaning process. Ideally, a temporary corner guard could be placed without affixing it to the wall being protected, and it would remain in place throughout the cleaning process, even as heavy hoses are dragged against it

SUMMARY

It is the object of the present invention to improve the stability of temporary corner guards. The Improved Temporary Corner Guard achieves enhanced stability through strategic selection of total device mass, mass distribution, and frictional properties of the selected materials. The Improved Temporary Corner Guard has a total device mass that is higher than commercially available corner guards. The device mass is strategically distributed, with the bulk of the weight residing in the base portion of the device. The device may also employ materials or coatings that have a higher coefficient of friction when placed against the outside corners, which would further enhance the ability to resist being upset if a lateral force is applied during use.

DEFINITIONS

Figure 1:
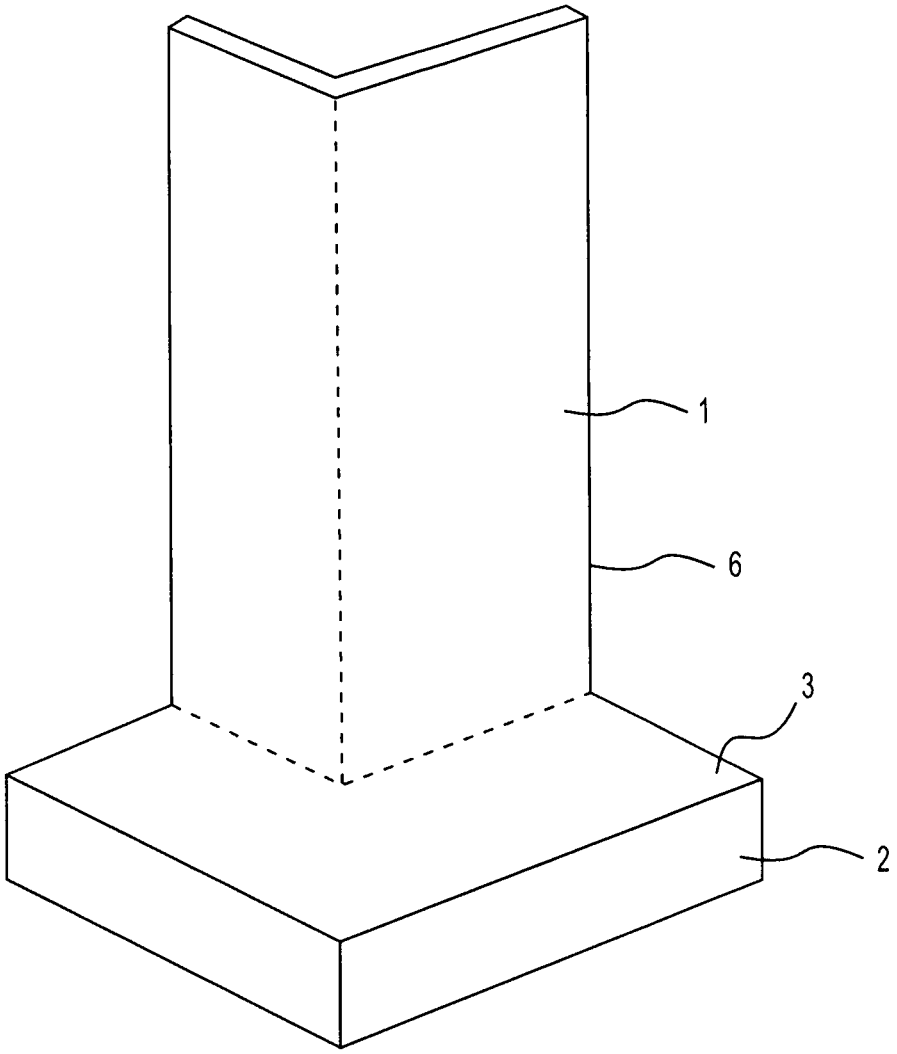
FIG. 1 is a front angular perspective view of the preferred embodiment.

Center of gravity refers to the point or average location of the weight of a particular object and is also the point from which a body or system may be considered to act

DETAILED DESCRIPTION

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used-to the extent possible-in combination with and/or in the context of other particular aspects and embodiments of the invention, and in the invention generally The term "comprises" and grammatical equivalents thereof are used herein to mean that other components, ingredients, steps, etc. are optionally present. For example, an article "comprising" (or "which comprises") components A, B, and C can consist of (i.e. contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range including that number (which may be a range having an upper limit or no upper limit, depending on the variable being defined). For example, "at least 1" means 1 or more than 1. The term "at most" followed by a number is used herein to denote the end of a range, including that number (which may be a range having 1 or 0 as its lower limit, or a range having no lower limit depending upon the variable being defined). For example, "at most 4" means 4 or less than 4, and "at most 40%" means 40% or less than 40%. When, in this specification, a range is given as "(a first number) to (a second number)" or "(a first number)—(a second number)," this means a, range whose limits include both numbers. For example. "25 to 100" means a range whose lower limit is 25 and upper limit is 100, and includes both 25 and 100.

The preferred embodiment of the present invention is a weighted device that uses two vertical plates that form a 90 degree angle. The device mass is strategically distributed, with the bulk of the weight residing in the base portion of the device. This can be achieved by coupling a weight or weighted object, such as a bean bag or sand bag, underneath a horizontal base plate which is coupled to the two vertical plates. The distribution of the bulk of the added weight to the base lowers the device's center of gravity which in turn increases stability. Thus, the added weight minimizes the chances of a user knocking over the device when the device is in use. Also, the preferred embodiment of the present invention features vertical and horizontal plates preferably of unibody design made of plastic or synthetic polymer including polypropylene and nylon. Additionally, the preferred embodiment has a high friction coating on the side facing the corner to increase stability when the device is against the walls of a corner. In some embodiments, the device may comprise a non-stick coating on the side not facing the corner to reduce friction and further maintain stability in case an object such as a hose comes into contact with this outer surface.

An alternative embodiment features weights or weight devices, such as bean bags or sand bags, removably affixed to the bottom, external corners of the device where the vertical plates meet the base plate. The weights essentially sit on the outside of the walls and on top of the base plate to allow a similar low center of gravity. This embodiment may or may not feature an additional weighted object affixed underneath the base plate, but in either case, the weights located on the outside should be enough to increase stability similar to that of the preferred embodiment. Because the weights are removably affixed, the user can increase or decrease the weight as needed or if desired.

Another alternative embodiment of the present invention features protective material affixed to the backsides of the vertical plates of a device with weights or weighted objects affixed underneath the base plate or on top of the baseplate. The back sides of the vertical plates, which together form a 90 degree angle, are what make contact with the corner that a user is trying to protect Instead of a special coating to increase the friction between the corner and the vertical walls of the device, special protective pads are affixed to the contact side of the vertical walls. These pads will come into contact with the corner rather than the actual surface of the rear side of the vertical walls. The pads can also be coated with a high friction coating or be comprised of similar, high friction material including rubber.

Another alternative embodiment features vertical plates joined to form obtuse and acute angles to accommodate objects and corners of different sizes.

FIG. 1 is a front angular perspective view of the device with two vertical plates 1 forming a 90 degree angle and a horizontal base plate 3. The three plates are all part of a unibody design made from plastic or synthetic polymer such as vinyl, nylon, or polyurethane. The surface of the plates are coated with a high friction coating 6 to increase stability when in use and placed against a corner. Underneath the horizontal base plate is a weight or weighted object 2 such as a bean bag or sand bag. Keeping the bulk of the weight at the bottom of the device lowers the device's center of gravity and increases stability to minimize the chance of a user knocking over the device when in use.

Figure 2:
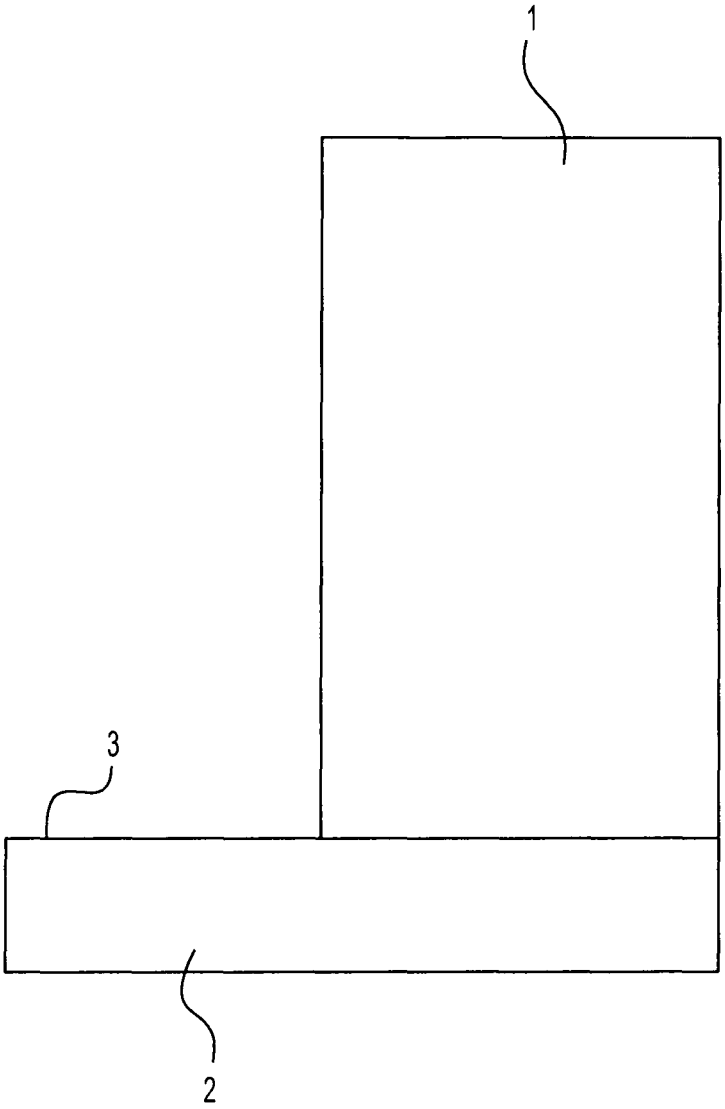
FIG. 2 is a side view of the preferred embodiment

FIG. 2 is a side view of the preferred embodiment The base plate 3 and the weighted object 2 protrude beyond the vertical plates 11 to create the front of the device and ensure maximum stability and minimize the chance of the device tipping forward. The vertical plates are perpendicular to the horizontal base plate and from the side, they should appear to form an "L" or backwards "L" shape, depending on which side you view the device from. Additionally, the vertical plates, the horizontal base plate, and the weighted object are coupled so that no one piece is protruding in the rear. This allows the device to sit flush against the surface of the corner the device is meant to protect.

Figure 3:
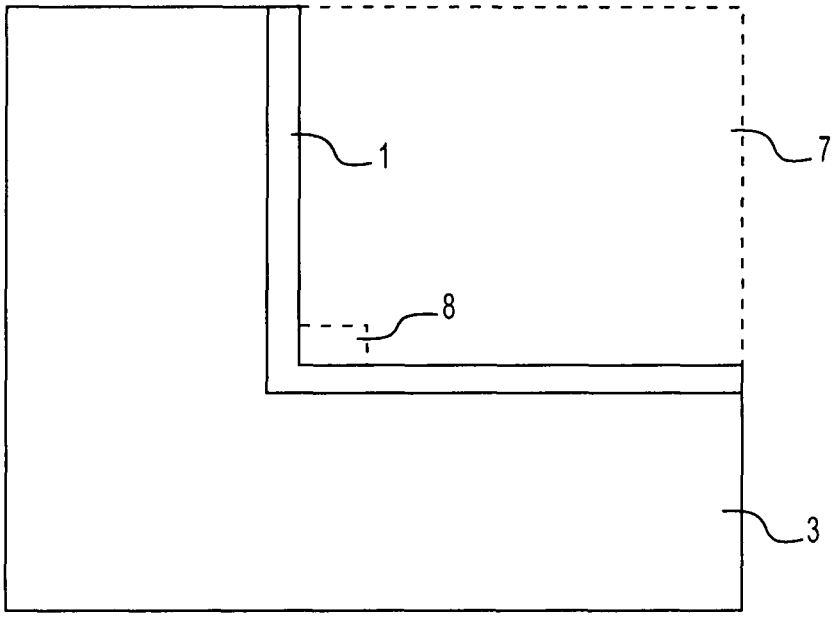
FIG. 3 is a top view of the preferred embodiment.

FIG. 3 is a top view of the preferred embodiment and shows the space 7 created by the 90 degree angle 8 of the vertical plates. This space will be occupied by a wall corner such that the surface of said corner will come into contact with the surface of vertical plates in the rear.

Figure 4:
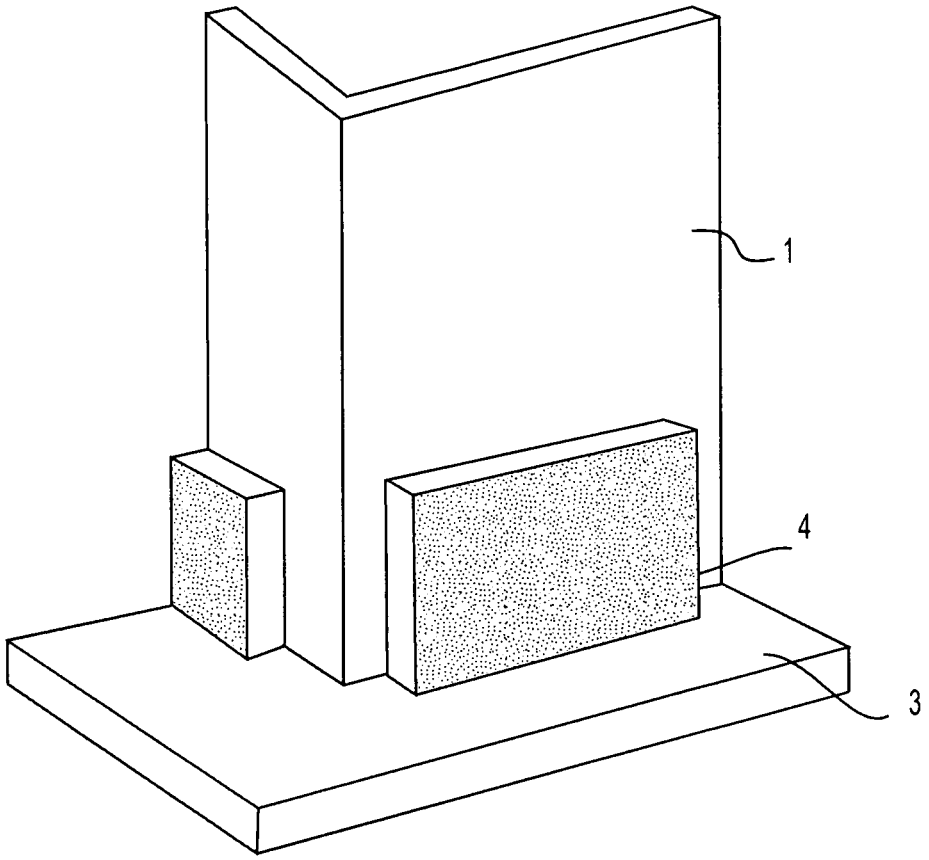
FIG. 4 is a front angular perspective view of an alternative embodiment showing outer weight attachments.

FIG. 4 is a front angular perspective view of an alternative embodiment featuring external weights or weighted objects 4 located above the base plate portion 3 and sits against the vertical plates 1 of the device. This configuration essentially creates a similar effect of lowering the center of gravity of the device because of the lower, near-baseline location of the weight<.

Figure 5:
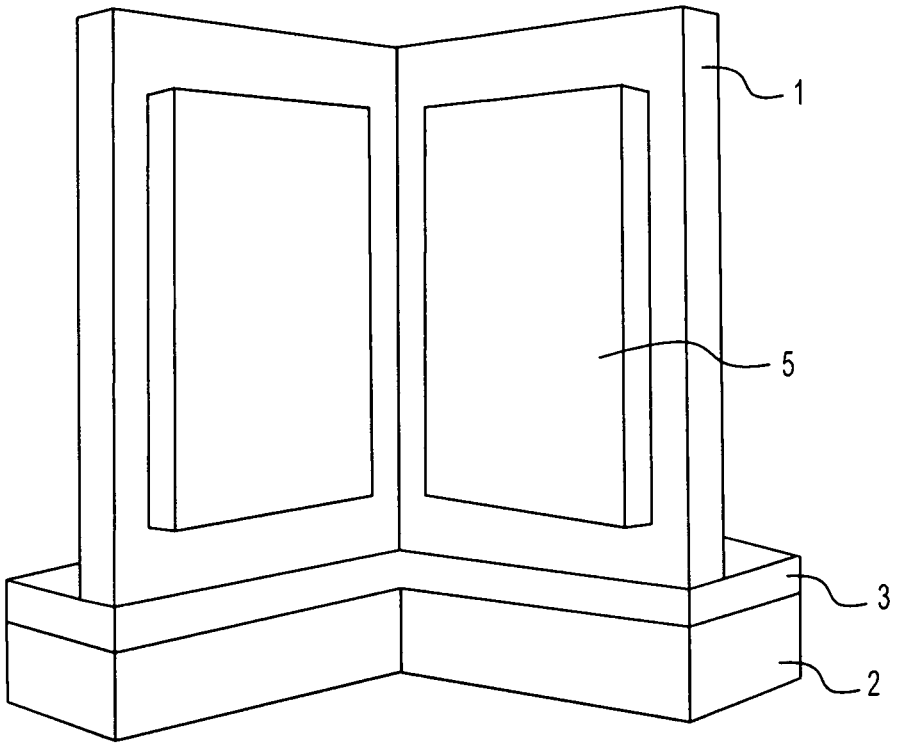
FIG. 5 is a side view of the alternative embodiment in FIG. 4.

FIG. 5 is a rear view of a second alternative embodiment that features a weighted object 2 underneath the base plate 3 with rear protective objects 5 affixed to the rear surface of each vertical plate 1. These protective objects are made of protective material, preferably lightweight, such as a foam, rubber, or additional plastic or foam with a rubberized coating. This will allow further corner protection when the device is in use because the protective objects, rather than the actual surfaces of the vertical plates, will be in contact with the surface of the corner walls. The protective objects may be weighted, but because adding weight to the upper area of the device will make the device less stable, a heavier weight or weighted object should be affixed beneath the base plate to lower the center of gravity in compensation.

Figure 6:
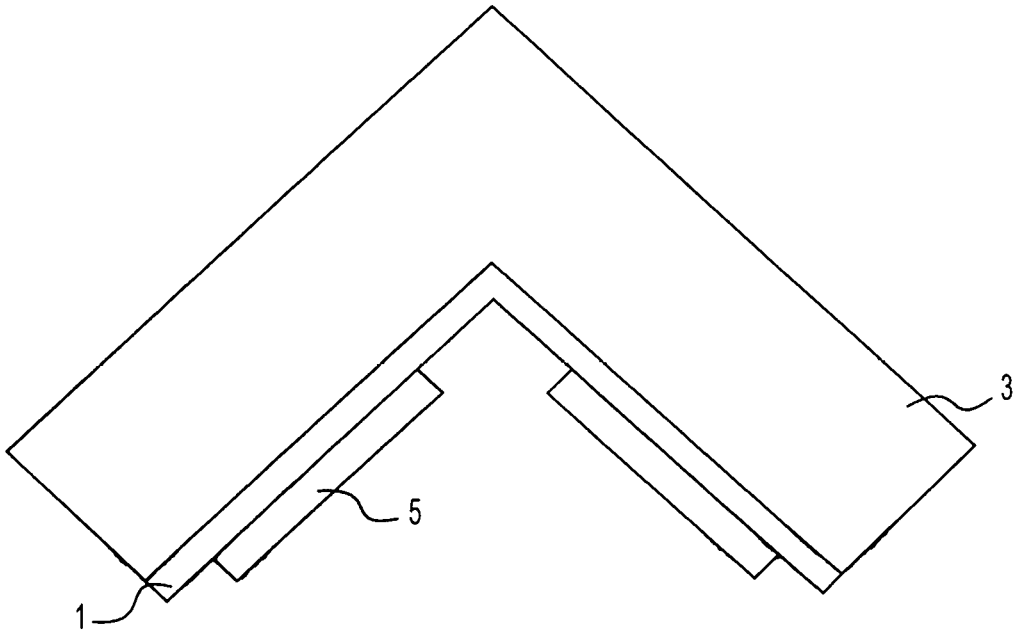
FIG. 6 is a top view of the alternative embodiment in FIG. 4.

FIG. 6 is a top view of the second alternative embodiment showing the protective objects 5 affixed to and protruding from the rear surfaces of the vertical plates. The protrusion prevents the surface of the plates as well as any other surfaces of the device other than the protective objects from coming into contact with a corner when the device is in use.

While preferred and alternate embodiments have been illustrated and described, as noted above, many changes can be made without departing from the spirit and scope of this IMPROVED TEMPORARY CORNER GUARD. Accordingly, the scope of the IMPROVED TEMPORARY COR- NER GUARD is not limited by the disclosure of these preferred and alternate embodiments. Instead, the scope of the IMPROVED TEMPORARY CORNER GUARD is to be determined entirely by reference to the claims. Insofar as the description above and the accompanying drawings (if any) disclose any additional subject matter that is not within the scope of the claims below, the inventions are not dedicated to the public and Applicant hereby reserves the right to file one or more applications to claim such additional inventions.

The reader's attention is directed to all papers and documents which are filled concurrently with this specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example of a generic series of equivalent or similar features.

Any element in a claim that does not explicitly state "means for" performing a specified function, or "step for" performing a specific function is not to be interpreted as a "means" or "step" clause as specified in 35. U.S.C. § 112, r 6. In particular, the use of "step of" in the claims herein is not intended to invoke the provisions of U.S.C. § 112, r 6.

The invention claimed is:

1. A temporary corner guard device comprising:

a first plate and a second plate, each said plate having a length, a width, a first longitudinal edge, a second longitudinal edge opposite said first longitudinal edge, a first side edge and a second side edge opposite said first side edge; said width of said first plate being greater than said width of said second plate, said first plate being joined perpendicularly to said second plate along said first side edge of said first plate and said second side edge of said second plate;

a base plate consisting of six side surfaces, an upper surface and a lower surface, a first side surface of said six side surfaces having a length being the same as said width of said first plate and a second side surface of said six side surfaces having a length being the same as the width of said second plate, said second side surface of said base plate being perpendicular to said first side surface of said base plate, said first plate and said second plate being connected to said first side surface and said second side surface of said base plate, respectively, such that said plates extend perpendicularly away from said upper surface;

a weighted object having an upper surface connected to said bottom surface of said base plate, said upper surface of said weighed object having substantially the same shape as said lower surface of said base plate;

said temporary corner guard device being made from plastic;

whereby said corner guard is configured such that an inner surface of said first plate and said second plate temporarily abuts against a corner construction of a building and subject to removal.

2. A method of using a temporary corner guard device comprising:

providing the temporary corner guard device of claim 1;

placing said temporary corner guard device against a corner construction; and, removing said temporary corner device from said corner construction.

* * * * *